US007882657B2

(12) United States Patent
Duncan et al.

(10) Patent No.: US 7,882,657 B2
(45) Date of Patent: Feb. 8, 2011

(54) WINDOW ASSEMBLY WITH UPPER SASH RAIL STIFFENING MEMBER SUPPORTING TILT LATCH BOLTS

(75) Inventors: Michael A. Duncan, Mohnton, PA (US); Philip G. Morton, Germantown, OH (US); Christopher R. Ballard, Miamisburg, OH (US)

(73) Assignees: Deceuninck North America, LLC, Monroe, OH (US); Viwinco, Inc., Morgantown, PA (US)

( * ) Notice: Subject to any disclaimer, the term of this patent is extended or adjusted under 35 U.S.C. 154(b) by 0 days.

(21) Appl. No.: 12/012,995

(22) Filed: Feb. 6, 2008

(65) Prior Publication Data

US 2009/0193720 A1 Aug. 6, 2009

(51) Int. Cl.
*E05D 15/22* (2006.01)

(52) U.S. Cl. ..... 49/185; 49/183; 49/501

(58) Field of Classification Search ..... 49/501, 49/61, 63, 125, 163, 176, 185, 183, 184
See application file for complete search history.

(56) References Cited

U.S. PATENT DOCUMENTS 2,927,354 A * 3/1960 Lauer ..... 49/34
4,309,845 A * 1/1982 Schmidt ..... 49/501
4,351,131 A * 9/1982 Kubik ..... 49/501
4,428,156 A * 1/1984 Malm et al. ..... 49/501
4,478,003 A * 10/1984 Flett ..... 49/63
4,944,118 A * 7/1990 Biro ..... 49/504
4,949,506 A * 8/1990 Durham, Jr. ..... 49/449
4,958,468 A * 9/1990 Nolan ..... 52/204.51
5,014,466 A * 5/1991 Winner ..... 49/504
5,274,955 A * 1/1994 Dallaire et al. ..... 49/406
5,289,659 A * 3/1994 Harrison ..... 49/501
5,511,352 A * 4/1996 Sholton ..... 52/306
6,006,478 A * 12/1999 Hubner et al. ..... 52/204.5
6,434,899 B1 * 8/2002 Fortin et al. ..... 52/232
6,434,905 B1 * 8/2002 Sprague ..... 52/474
6,675,537 B2 1/2004 Morton et al.
6,802,156 B2 * 10/2004 Sherrett et al. ..... 49/445
6,826,871 B2 12/2004 Morton et al.
6,957,513 B2 * 10/2005 Pettit et al. ..... 49/185
7,013,603 B2 * 3/2006 Eenigenburg et al. ..... 49/185
7,070,211 B2 7/2006 Polowinczak et al.
7,104,015 B2 * 9/2006 Huynh ..... 52/208
7,296,381 B1 * 11/2007 McCabe et al. ..... 49/454
7,322,619 B2 * 1/2008 Nolte et al. ..... 292/175
7,448,164 B1 * 11/2008 McCabe ..... 49/185

(Continued)

*Primary Examiner*—Jerry Redman
(74) *Attorney, Agent, or Firm*—Jacox, Meckstroth & Jenkins

(57) ABSTRACT

A single or double hung window assembly has a rectangular main frame supporting at least one rectangular sash frame for vertical sliding movement, and each frame has members formed from extrusions including rigid plastics material. A horizontal upper sash rail or member is reinforced by an elongated and continuous metal stiffening channel having a width substantially greater than its height and defining a longitudinally extending and upwardly facing undercut cavity. End portions of the stiffening channel support retractable sliding tilt latch bolts each having a snap-fit connection to a corresponding actuator slidably mounted on the upper sash rail. A sash lock member is also mounted on the upper sash rail and is secured to the stiffening channel. A pre-assembly of the stiffening channel and latch bolts is inserted through an opening in a vertical sash frame member, and stiffening channels are also inserted into other sash frame members.

6 Claims, 2 Drawing Sheets

U.S. PATENT DOCUMENTS 7,571,568 B2 * 8/2009 Ito et al. ..... 49/181
2004/0139655 A1 * 7/2004 Morton et al. ..... 49/163
2007/0137109 A1 * 6/2007 Tremble et al. ..... 49/185

* cited by examiner

WINDOW ASSEMBLY WITH UPPER SASH RAIL STIFFENING MEMBER SUPPORTING TILT LATCH BOLTS

BACKGROUND OF THE INVENTION

This invention relates to a double hung or single hung window assembly fabricated from extrusions of rigid plastics material such as rigid polyvinyl chloride, and of the general type disclosed in U.S. Pat. No. 6,675,537 and No. 6,826,871 assigned to the assignee of the present invention, and the disclosures of which are herein incorporated by reference. In such window assemblies, and especially large window assemblies, the horizontal sash rail members are typically not sufficiently stiff to withstand the structural pressures resulting from high winds which occur, for example during a hurricane or tornado, and which tend to pull the fabricated sash frame and glass assembly out of the fabricated main frame assembly. Thus the sash frame members are commonly reinforced with stiffening bars or members which are configured to fit with minimum clearance inside the hollow sash rail members, for example, as disclosed in above-mentioned U.S. Pat. No. 6,826,871.

The vertically sliding window units of a single hung or double hung window assembly are also commonly designed so that the movable or operable sash frames can be disengaged from the outer main frame and then tilted inwardly of the building to provide access for cleaning the exterior surface of the glass window panel from the interior of the building. The tilt latches, such as disclosed in the above-mentioned patents and in other U.S. patents, are designed for releasably securing the upper sash rail of the operable sash frame in its normal operating position and may be released or disengaged for tilting the sash frame into the building. Sometimes, the tilt latch bolts may be integrated or connected to the sash frame security lock mechanism which are partially recessed within the upper rail of the movable sash frame, for example, as disclosed in U.S. Pat. No. 7,070,211.

SUMMARY OF THE INVENTION

The present invention is directed to an improved single hung or double hung window assembly and which includes a rectangular main frame having a pair of vertical jamb members rigidly connected by a horizontal sill member and a horizontal head member. The main frame supports at least one vertically movable or operable rectangular sash frame having vertical sash frame members rigidly connected by horizontal sash frame members or rails and supporting a glass panel unit. All of the frame members are formed from extrusions comprising a rigid plastic material, and the upper sash frame member or rail of each vertically movable or operable window unit incorporates an elongated stiffening bar or member which not only reinforces the sash frame rail but also functions as a housing for supporting the tilt latch bolts which releasably engage the vertical jamb members of the outer main frame.

The stiffening bar or member has a continuous profile or cross-section along its entire length and extends from the left jamb member of the outer frame to the right jamb member of the outer frame. The bottom horizontal sash frame member or rail may also be configured to receive the stiffening bar or member so that different stiffening bars are not required, for example, as disclosed in above-mentioned U.S. Pat. No. 6,826,871. The stiffening bar or member which carries the tilt latch bolts may also be pre-assembled and conveniently assembled into the upper sash frame rail through an opening within an upper end portion of a vertical sash frame member after the corners of the sash frame members are secured or welded together. The stiffening bar or member also forms a structurally rigid support for attaching a security sash lock member on the top surface of the upper sash frame rail of the operable window unit.

DESCRIPTION OF THE PREFERRED EMBODIMENT

Figure 1:
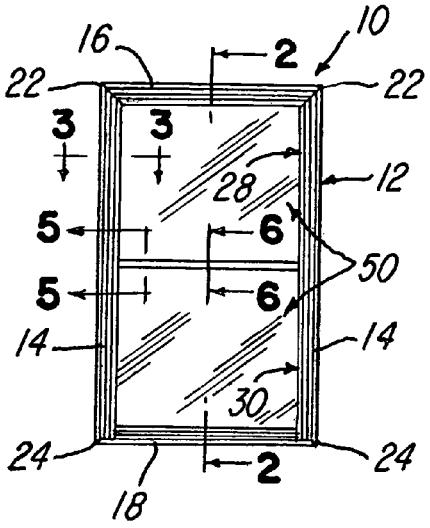
FIG. 1 is an elevational view of a double hung window assembly constructed in accordance with the invention.
Figure 2:
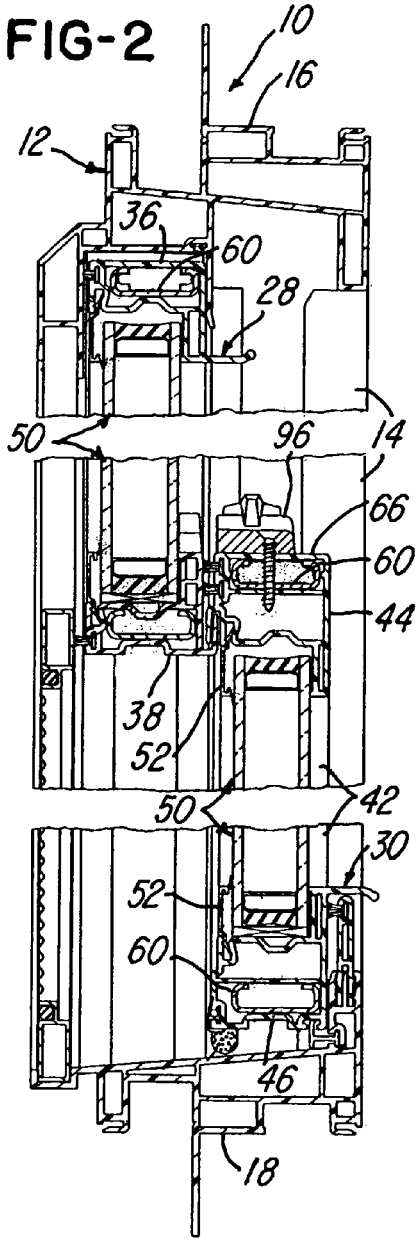
FIG. 2 is a larger vertical section of the window assembly taken generally on the line 2-2 of FIG. 1 and with upper and lower portions broken away.
Figure 3:
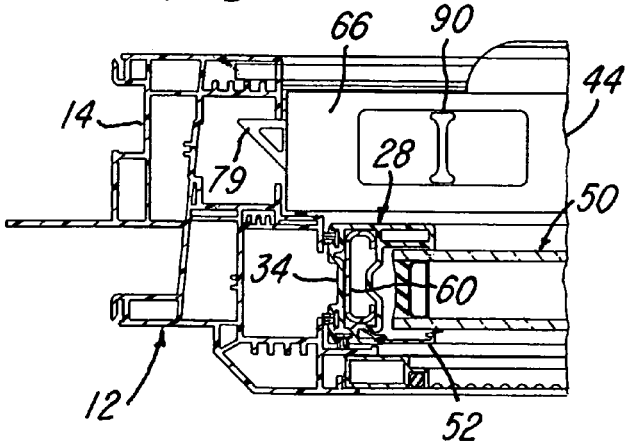
FIG. 3 is a fragmentary section taken generally on the line 3-3 of FIG. 1.

FIG. 1 illustrates a double hung window assembly 10 which includes a rectangular outer main frame 12 formed by a pair of vertical frame or jamb members 14 connected by a horizontal head member 16 and a horizontal sill member 18. The main frame members 14, 16 and 18 are formed from extrusions of a rigid material including a rigid plastics material such as a rigid polyvinylchloride (PVC) with the extruded sections having 45 degree mitered ends rigidly connected or welded to form mitered upper corner joints 22 and lower corner joints 24. The main frame 12 is constructed generally the same as disclosed in above-mentioned U.S. Pat. No. 6,675,537, the disclosure of which is herein incorporated by reference. As also disclosed in this patent, the main frame 12 supports an upper sash frame 28 and a lower sash frame 30 for vertical sliding movement between closed positions (FIGS. 1 & 2) and open positions (not shown). The upper sash frame 28 is formed by a pair of vertical sash members 34 (FIG. 3) rigidly connected by a horizontal upper sash frame member or rail 36 (FIG. 2) and a horizontal lower sash frame member or rail 38. Similarly, the lower sash frame 30 is formed by a pair of vertical sash frame members 42 (FIG. 2) rigidly connected by an upper sash frame member or rail 44 and a horizontal lower sash frame member or rail 46. All of the sash frame members are also formed from extrusions including a rigid plastics material such as PVC, and the vertical and horizontal sash frame members are rigidly connected by welded mitered corners. Each of the sash frames 28 and 30 encloses insulated glazing panels or a glass unit 50 which is removably retained by extruded plastic removable glazing beads 52. The disclosures of above-mentioned U.S. Pat. No. 6,675,537 and No. 6,826,871 are referred to for further details of construction of the window assembly 10.

Figure 5:
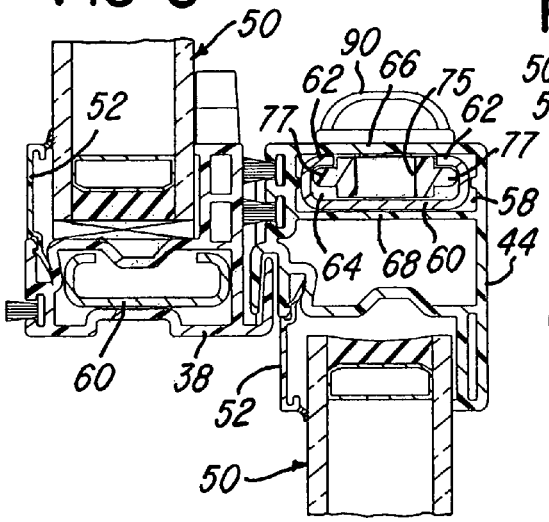
FIG. 5 is an enlarged fragmentary section taken generally on the line 5-5 of FIG. 1.

In accordance with the present invention, the upper horizontal sash member or rail 44 of the lower sash frame 30 is extruded with an upper rectangular cavity or chamber 58 (FIGS. 5 & 6) which receives a rigid reinforcing and stiffening member 60 in close fitting relation. The stiffening member 60 is preferably in the form of a roll-formed or extruded metal or aluminum C-shaped channel 60 having longitudinally extending and opposing top return flanges 62 defining a longitudinally extending undercut cavity 64. The stiffening channel 60 has a horizontal width substantially greater than its vertical thickness and extends closely between a top wall 66 and a parallel intermediate or inner wall 68 and the opposite side walls of the upper sash rail 44. The channel 60 extends the full length of the upper sash rail 44 and has a uniform cross-sectional configuration or profile along its entire length in order to provide the strength necessary to resist bending or bowing of the sash rail.

Figure 4:
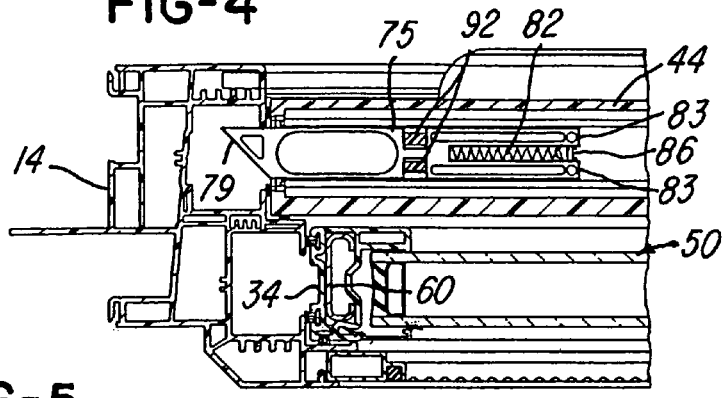
FIG. 4 is a fragmentary section similar to FIG. 3 with the top wall of the upper sash frame rail broken away.

As shown in FIG. 4, the opposite end portions of the stiffening member or channel 60 support corresponding tilt latch bolts 75 for horizontal sliding movement. Each bolt 75 is preferably molded of a rigid plastics material and has longitudinally extending ribs 77 projecting along opposite sides under the return flanges 62 of the stiffening channel 60. Each tilt latch bolt 75 also has a triangular shape outer end portion 79 which normally engages and locks to the adjacent jamb member 14 of the main window frame 12. Each latch bolt 75 is biased outwardly by a compression spring 82 (FIG. 4) which extends between parallel spaced legs 83 of the latch bolt and engages a tab 86 formed or lanced upwardly from the bottom wall of the stiffening channel 60. Each of the latch bolts 75 is manually shifted between its normal extended latch position (FIG. 4) and a retracted position compressing the spring 82 by a molded plastic thumb actuator 90 (FIG. 3) having a pair of downwardly projecting hook shaped fingers or tabs 92 (FIG. 4) which extend through corresponding slots within the top wall 66 and into recesses within the latch bolt and snap-fit onto the latch bolt. The tilt latch bolt actuators 90 slide on the top wall 66 of the upper sash member or rail 44.

Figure 6:
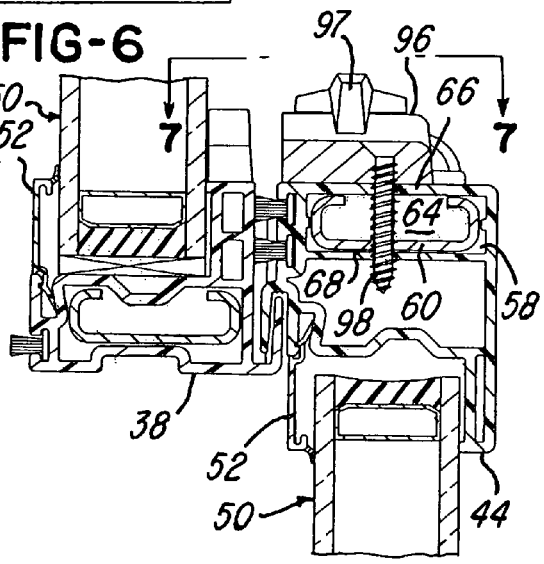
FIG. 6 is an enlarged fragmentary section taken generally on the line 6-6 of FIG. 1.
Figure 7:
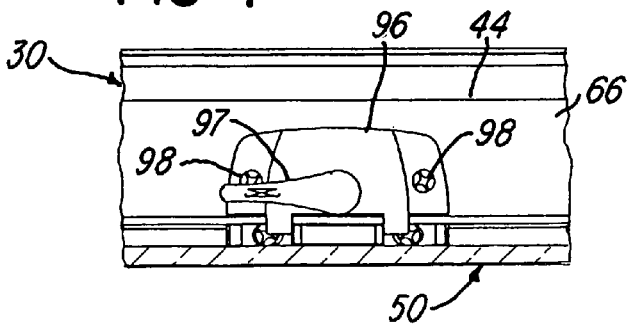
FIG. 7 is a reduced fragmentary section taken generally on the line 7-7 of FIG. 6.

As shown in FIGS. 6 & 7, the upper wall 66 of the sash rail 44 also supports a sash lock member 96 of a conventional cam operated security lock having a rotatable locking lever 97. The sash lock member 96 is rigidly secured to the stiffening channel 60 by a pair of self-tapping screws 98 threaded into the top wall 66, the bottom wall of the channel 60 and also through the intermediate wall 68 of the upper sash rail 44. As also shown in FIGS. 2-6, each of the other vertical and horizontal sash frame members 34, 36 and 38 of the upper sash frame 28 and the vertical and horizontal sash frame members 42 and 46 of the lower sash frame 30 are extruded with cavities or chambers similar in cross-section to the chamber 58 for also receiving and confining sections of the stiffening member or channel 60 for further reinforcing the sash frames. The stiffening channel 60 in the upper horizontal sash member 36 also supports tilt latch bolts 75 to provide for tilting the upper sash frame 28 inwardly for cleaning after the lower sash frame 30 is tilted inwardly for cleaning.

From the drawings and the above description, it is apparent that a window assembly constructed in accordance with the invention provides desirable features and advantages. For example, the uniform cross-sectional configuration of the stiffening member or channel 60 along its entire length not only provides substantial strength and rigidity to the sash members to resist high wind forces such as occurs during a hurricane or tornado, but the stiffening channels 60 in the upper sash members 44 and 36 also provide a rigid and high strength support housing for the corresponding sliding tilt latch bolts 75. As another advantage and feature, the two tilt latch bolts 75 and the corresponding compression springs 82 may be pre-assembled into the stiffening channel 60. This pre-assembly may then be inserted into the chamber 58 through a rectangular opening in a vertical sash frame member 34 after the mitered corners have been welded together. The hook-shaped tabs 92 of the latch bolt actuators 90 are then snap-fitted onto the corresponding latch bolts through the corresponding slots within the top wall 66 of the sash rail. As a further advantage, the configuration or profile of the stiffening member 60 also permits additional linear sections of the stiffening member 60 to be inserted in the other sash frame members 34, 36, 38, 42 and 46 for reinforcing and stiffening the members, as shown in FIGS. 2-6.

While the form of window assembly herein described constitutes a preferred embodiment of the invention, it is to be understood that the invention is not limited to this precise form of window assembly, and that changes may be made therein without departing from the scope and spirit of the invention as defined in the appended claims.

What is claimed is:

1. A window assembly comprising a main frame including two vertical main frame members rigidly connected by an upper and a lower horizontal main frame members with said vertical main frame members including horizontally spaced opposing vertical guide walls, at least one sash frame having elongated vertical sash frame members rigidly connected by elongated horizontal sash frame members and enclosing a glazing unit, with said sash frame supported by said vertical main frame members for vertical movement between open and closed positions, all of said main frame members and all of said sash frame members comprising a rigid plastics material, an upper said horizontal sash frame member including spaced vertical side walls connected by a horizontal top wall and a horizontal intermediate wall, with all of said walls cooperating to define a longitudinally extending internal cavity extending horizontally between said vertical main frame members, an elongated metal reinforcement channel extending continuously within said cavity from outer vertical side surfaces of said sash frame 30 and having a uniform C-shape cross-section formed by a horizontal bottom wall integrally connecting opposite vertical side walls with opposing horizontal top return flanges projecting inwardly from said side walls and defining a longitudinal continuous top opening, said bottom wall, said side walls and said return flanges of said channel extending continuously the entire length of said channel to said vertical main frame members and defining within said channel an undercut cavity with said channel having a horizontal width substantially greater than its vertical height, an elongated tilt latch reinforcement bolt having a horizontal width substantially greater than its vertical height and supported for horizontal sliding movement within each of the opposite end portions of said channel with each said tilt latch bolt substantially filling said undercut cavity and biased outwardly by a compression spring within said channel to engage one of said vertical guide walls, and a tilt latch bolt actuator slidably mounted on each end portion of said upper sash frame member with each said actuator including a member projecting downwardly through said top opening of said channel and connected to the corresponding said tilt latch bolt.

2. A window assembly as defined in claim 1 wherein said metal reinforcement channel comprises a roll-formed metal channel having four longitudinally extending rounded corner portions.

3. A window assembly as defined in claim 1 wherein said bottom wall of said channel includes an integral tab projecting upwardly into said undercut cavity to position said compression spring between parallel spaced legs of said tilt latch bolt within said channel.

4. A window assembly as defined in claim 1 wherein one of said vertical sash frame members of said sash frame has a top portion with an opening for inserting said reinforcement channel after said channel is preassembled with each said tilt latch reinforcement bolt and corresponding said compression spring and after said vertical sash frame member is welded to said horizontal sash frame member.

5. A window assembly as defined in claim 1 wherein each said tilt latch reinforcement bolt includes a longitudinal top portion projecting into said top opening of said reinforcement channel between said top return flanges and further includes longitudinally extending and laterally outwardly projecting opposite side ribs slidable under said top return flanges.

6. A window assembly as defined in claim 1 wherein a lower said horizontal sash frame member of said sash frame defines a longitudinally extending horizontal cavity adjacent a bottom wall of said lower sash frame member, an elongated roll-formed said reinforcing channel extending within said cavity adjacent said bottom wall and having opposite end portions adjacent said vertical main frame members, and said channel having four longitudinally extending rounded corner portions.

* * * * *